US005653732A

United States Patent [19]

Sheehy

[11] Patent Number: 5,653,732

[45] Date of Patent: Aug. 5, 1997

[54] NATURAL FORMED NIPPLE FOR A BABY BOTTLE

[76] Inventor: Candice L. Sheehy, 11050 Moffat Rd., Lexington, Okla. 73051

[21] Appl. No.: 349,016

[22] Filed: Dec. 2, 1994

[51] Int. Cl.[6] ..... A61J 17/00

[52] U.S. Cl. ..... 606/236; 215/11.1

[58] Field of Search ..... 215/11.1–11.6; 606/234–236; 374/161

[56] References Cited

U.S. PATENT DOCUMENTS 3,358,864 12/1967 Meierhoefer ..... 215/11.6

4,623,069 11/1986 White ..... 215/11.4

5,108,686 4/1992 Griffin ..... 606/236

*Primary Examiner*—Gary Jackson

*Assistant Examiner*—Glenn Dawson

*Attorney, Agent, or Firm*—Michael I. Kroll

[57] ABSTRACT

A natural formed nipple for a baby bottle, having an externally threaded neck and an internally threaded cap with a central aperture. The nipple includes a mouthpiece constructed as close as possible to the shape of a female human breast. A structure is for securing the mouthpiece at the central aperture in the internally threaded cap to a top edge of the externally threaded neck of the baby bottle in a waterproof sealed manner. When a baby suckles on the mouthpiece, it will make the weaning process easier for the baby.

7 Claims, 2 Drawing Sheets

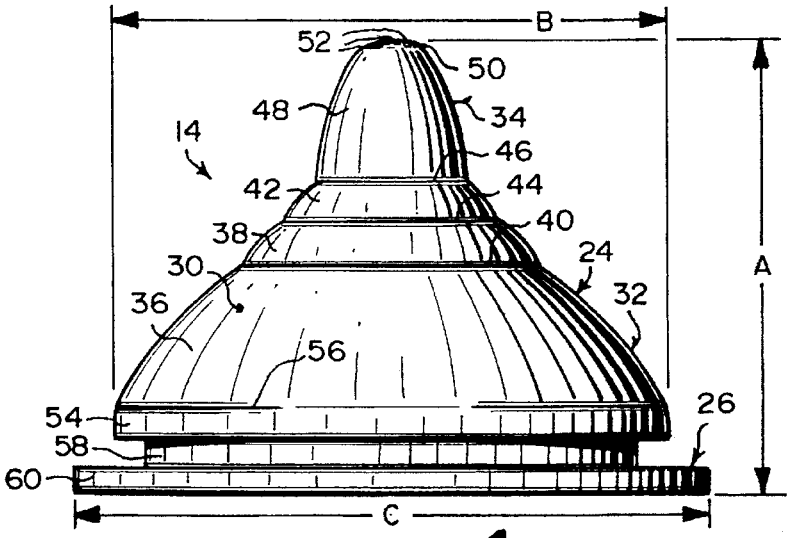
Fig. 4
Fig. 5
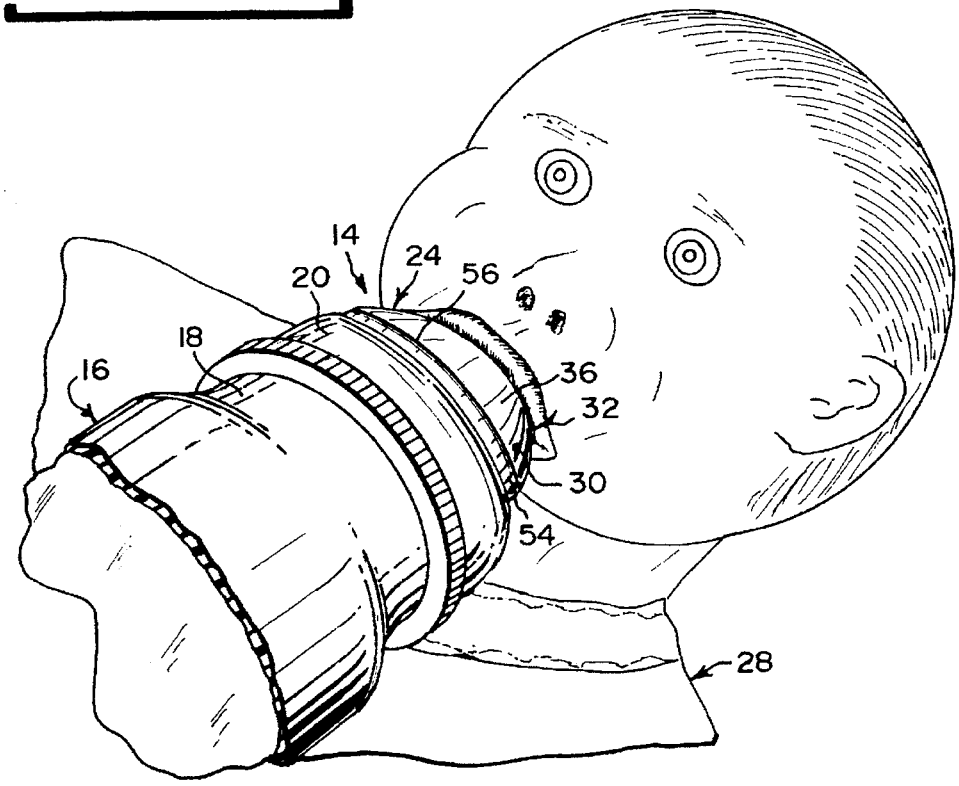

NATURAL FORMED NIPPLE FOR A BABY BOTTLE

BACKGROUND OF THE INVENTION

1. Field of the Invention

The instant invention relates generally to baby bottle nipples and more specifically it relates to a natural formed nipple for a baby bottle.

2. Description of the Prior Art

Breast-fed babies open their mouths wide to take in a lot of the breast. The babies have trouble during the weaning process to go from breast-feeding to bottle feeding. The nipple products offered on the market today have very small tips, which most babies find difficult to adapt to. These nipple products do not even come close in resemblance to the shape of a female human breast.

Numerous baby bottle nipple have been provided in prior art that try to take the place of the female human breast when feeding the babies, but do not quite accomplish this function. While these units may be suitable for the particular purpose to which they address, they would not be as suitable for the purposes of the present invention as heretofore described.

SUMMARY OF THE INVENTION

A primary object of the present invention is to provide a natural formed nipple for a baby bottle that will overcome the shortcomings of the prior art devices.

Another object is to provide a natural formed nipple for a baby bottle that is constructed as close as possible to the shape of a female human breast, to make the weaning process easier and give a baby which is not breast fed a more natural shaped nipple.

An additional object is to provide a natural formed nipple for a baby bottle, in which the side of the mouthpiece, made of pliable latex material, is longer and curved with small ridges close to the tip, while the tip has three small holes instead of one large one, so that it will conform to the mouth of the baby instead of the mouth of the baby having to conform to the mouthpiece.

A further object is to provide a natural formed nipple for a baby bottle that is simple and easy to use.

A still further object is to provide a natural formed nipple for a baby bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 4 is a side elevational view of the instant invention per se.

FIG. 5 is a perspective view, showing a baby utilizing the instant invention on a baby bottle.

Similar reference characters denote corresponding features consistently throughout the attached drawings.

DETAILED DESCRIPTION OF TEE PREFERRED EMBODIMENTS

Figure 1:
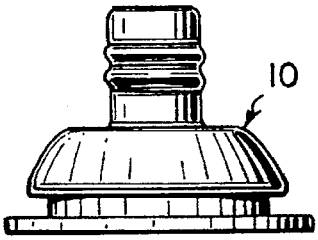
Fig. 1 (PRIOR ART)
FIG. 1 is a side elevational view of the prior art being a standard PLAYTEX nipple.
Figure 2:
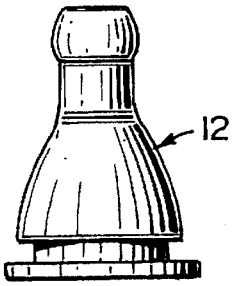
Fig. 2 (PRIOR ART)
FIG. 2 is a side elevational view of the prior art being a standard EVENFLO nipple.

Turning now descriptively to the drawings, in which similar reference characters denote similar elements throughout the several views, FIGS. 1 and 2 illustrate the prior art, being in FIG. 1 a standard PLAYTEX nipple 10 and in FIG. 2 a standard EVENFLO nipple 12. The are both not in the proper shape of a female human breast and therefore, a baby will find it difficult to adapt to these nipple, since the mouth of the baby will have to conform to the nipples 10 and 12, shown in FIGS. 1 and 2.

Figure 3:
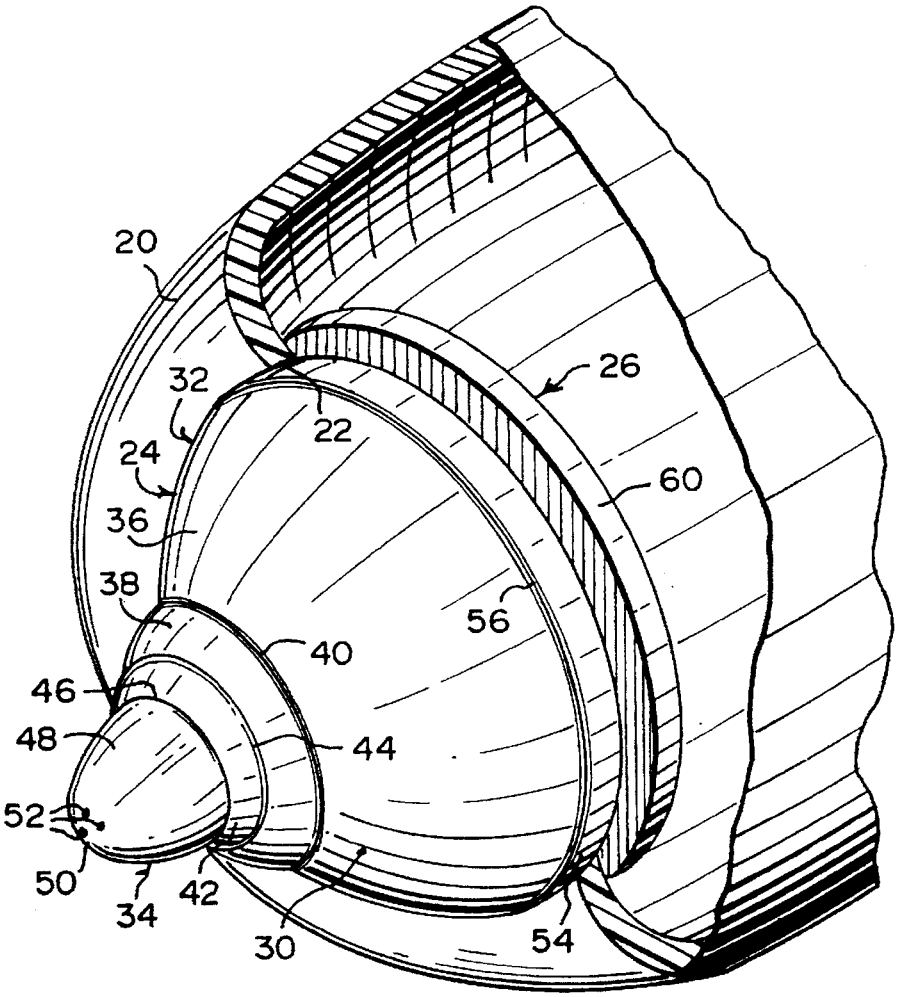
FIG. 3 is a perspective view of the instant invention and associated cap, which is broken away.

The invention as shown in FIGS. 3 to 5, is a natural formed nipple 14 for a baby bottle 16, having an externally threaded neck 18 and an internally threaded cap 20 with a central aperture 22. The nipple 14 comprises a mouthpiece 24 constructed as close as possible to the shape of a female human breast. A structure 26 is for securing the mouthpiece 24 at the central aperture 22 in the internally threaded cap 20 to a top edge of the externally threaded neck 18 of the baby bottle 16 in a waterproof sealed manner. When a baby 28 suckles on the mouthpiece 24, it will make the weaning process easier for the baby 28.

The mouthpiece 24 and the securing structure 26 are integral and fabricated out of a pliable latex material 30. The mouthpiece 24 includes a dome-shaped crown 32 and a tip 34 extending upwardly from the dome-shaped crown 32.

The dome-shaped crown 32 consists of a lower segment 36 having a large curved outer surface. An intermediate segment 38 has a smaller curved outer surface than the lower segment 36. A first annular ridge 40 is between the lower segment 36 and the intermediate segment 38. An upper segment 42 has a smaller curved outer surface than the intermediate segment 38. A second annular ridge 44 is between the intermediate segment 38 and the upper segment 42. A third annular ridge 46 is between the upper segment 42 and the tip 34.

The tip 34 is a small conical protuberance 48 on the third annular ridge 46, so as to simulate a female human teat. The small conical protuberance 48 contains a curved apex surface 50, having three small holes 52 therethrough, to allow any liquid within the baby bottle 16 to exit therefrom when the baby 28 suckles.

The securing structure 26 includes an annular base 54 at a bottom edge 56 of the lower segment 36 of the dome-shaped crown 32, being of the same diameter as the bottom edge 56 of the lower segment 36. An annular recessed collar 58 under the annular base 54 is of a smaller diameter than the annular base 54 and of the same diameter as the central aperture 22 in the cap 20. An annular flange 60 under the annular recessed collar 58 is of a larger diameter than the annular base 54 and the annular recessed collar 58 and of the same size as the internal diameter in the cap 20. The annular base 54 can be forced through the central aperture 22 in the cap 20, while the annular flange 60 will be held between the cap 20 and the top edge of the externally threaded neck 18 of the baby bottle 16.

The height from a bottom surface of the annular flange 60 to the curved apex surface 50 of the small conical protuberance 48 is approximately, but not limited to, one and one half inches. The diameter of the annular base 54, as indicated by letter B in FIG. 4, is approximately, but not limited to, one and seven eighths inches. The diameter of the annular flange 60, as indicated by letter C in FIG. 4, is approximately, but not limited to, two and one eighths inches.

LIST OF REFERENCE NUMBERS

A height of 14
B diameter of 54
C diameter of 60
10 standard PLAYTEX nipple
12 standard EVENFLO nipple
14 natural formed nipple
16 baby bottle
18 externally threaded neck on 16
20 internally threaded cap of 16
22 central aperture in 20
24 mouthpiece of 14
26 securing structure
28 baby
30 pliable latex material
32 dome-shaped crown of 24
34 tip of 24
36 lower segment of 32
38 intermediate segment of 32
40 first annular ridge between 36 and 38
42 upper segment of 32
44 second annular ridge between 38 and 42
46 third annular ridge between 42 and 34
48 small conical protuberance for 34
50 curved apex surface on 48
52 small hole in 50
54 annular base of 26
56 bottom edge of 36
58 annular recessed collar of 26
60 annular flange of 26

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A natural formed nipple for a baby bottle having an externally threaded neck and an internally threaded cap with a central aperture, said nipple comprising:

a) a mouthpiece generally configured to simulate a shape of a human breast; and b) means for securing said mouthpiece at the central aperture in the internally threaded cap to a top edge of the externally threaded neck of the baby bottle in a waterproof sealed manner, so that when a baby suckles on the mouthpiece it will make a weaning process easier for the baby, said mouthpiece and said securing means being integral and fabricated out of a pliable latex material, said mouthpiece including a dome-shaped crown, and a tip extending upwardly from said dome-shaped crown, said dome-shaped crown including a lower segment having a large curved outer surface, an intermediate segment having a smaller curved outer surface than said lower segment, a first annular ridge between said lower segment and said intermediate segment, an upper segment having a smaller curved outer surface than said intermediate segment, a second annular ridge between said intermediate segment and said upper segment, and a third annular ridge between said upper segment and said tip.

2. A natural formed nipple as recited in claim 1, wherein said tip is a small conical protuberance on said third annular ridge, so as to simulate a female human teat.

3. A natural formed nipple as recited in claim 2, wherein said small conical protuberance includes a curved apex surface having three small holes therethrough, to allow any liquid within the baby bottle to exit therefrom when the baby suckles.

4. A natural formed nipple as recited in claim 3, wherein said securing means includes:

a) an annular base at a bottom edge of said lower segment of said dome-shaped crown, being of the same diameter as a bottom edge of said lower segment;

c) an annular recessed collar under said annular base being of a smaller diameter than said annular base and d) an annular flange under said annular recessed collar being of a larger diameter than said annular base and said annular recessed collar, so that said annular base can be forced through the central aperture in the cap, while said annular flange will be held between the cap and a top edge of the externally threaded neck of the baby bottle.

5. A natural formed nipple as recited in claim 4, wherein the height from a bottom surface of said annular flange to said curved apex surface of said small conical protuberance is approximately one and one half inches.

6. A natural formed nipple as recited in claim 5, wherein the diameter of said annular base is approximately one and seven eighths inches.

7. A natural formed nipple as recited in claim 6, wherein the diameter of said annular flange is approximately two and one eighths inches.

* * * * *